US005915882A

United States Patent [19]

Darwiche et al.

[11] Patent Number: 5,915,882

[45] Date of Patent: Jun. 29, 1999

[54] JACK-UP PLATFORM LOCKING APPARATUS AND METHOD

[75] Inventors: Mahmoud K. M. Darwiche, Houston; Michael J. Dowdy; Julian F. Bowes, both of Longview, all of Tex.

[73] Assignee: LeTourneau, Inc., Houston, Tex.

[21] Appl. No.: 08/883,295

[22] Filed: Jun. 26, 1997

[51] Int. Cl.[6] ..... E02B 17/08

[52] U.S. Cl. ..... 405/198; 405/195.1; 405/196; 254/95; 254/106; 254/112

[58] Field of Search ..... 405/195.1, 196, 405/198; 254/89, 94, 95, 106, 108, 97, 112

[56] References Cited

U.S. PATENT DOCUMENTS

| | | | |
|---|---|---|---|
| Re. 29,539 | 2/1978 | Willke et al. . | |
| 2,308,743 | 1/1943 | Bulkley et al. . | |
| 2,589,146 | 3/1952 | Samuelson . | |
| 3,183,676 | 5/1965 | LeTourneau . | |
| 3,290,007 | 12/1966 | Yeilding . | |
| 3,343,371 | 9/1967 | Heitkamp . | |
| 3,606,251 | 9/1971 | Willke et al. . | |
| 3,945,450 | 3/1976 | Wilson et al. . | |
| 3,967,457 | 7/1976 | Lovie . | |
| 4,073,155 | 2/1978 | Schiemichen . | |
| 4,160,538 | 7/1979 | Armstrong . | |
| 4,195,950 | 4/1980 | Goldman . | |
| 4,199,276 | 4/1980 | Molsberger . | |
| 4,203,576 | 5/1980 | Sutton . | |
| 4,255,069 | 3/1981 | Yielding . | |
| 4,269,543 | 5/1981 | Goldman et al. . | |
| 4,389,140 | 6/1983 | Bordes | 405/198 X |
| 4,422,802 | 12/1983 | Choate . | |
| 4,431,343 | 2/1984 | Uchiyama et al. | 405/198 |
| 4,437,792 | 3/1984 | Durand et al. . | |
| 4,445,805 | 5/1984 | Ray et al. . | |
| 4,453,858 | 6/1984 | Guiader . | |
| 4,479,401 | 10/1984 | Korkut . | |
| 4,497,591 | 2/1985 | Gillis . | |
| 4,505,616 | 3/1985 | Grzelka et al. . | |
| 4,512,553 | 4/1985 | Dunham et al. | 254/95 X |
| 4,521,134 | 6/1985 | Schoonmade . | |
| 4,538,938 | 9/1985 | Grzelka et al. . | |
| 4,574,650 | 3/1986 | Durand et al. . | |
| 4,583,881 | 4/1986 | Steele . | |
| 4,589,799 | 5/1986 | Hotta et al. . | |
| 4,627,768 | 12/1986 | Thomas et al. . | |
| 4,655,640 | 4/1987 | Gillis . | |
| 4,657,437 | 4/1987 | Breeden . | |
| 4,657,438 | 4/1987 | Gillis . | |
| 4,662,787 | 5/1987 | Tatsuguchi . | |
| 4,668,127 | 5/1987 | Steele . | |
| 4,740,108 | 4/1988 | Levee et al. . | |
| 4,744,698 | 5/1988 | Dallimer et al. . | |
| 4,813,814 | 3/1989 | Shibuta et al. . | |
| 5,139,366 | 8/1992 | Choate et al. . | |
| 5,611,645 | 3/1997 | Breeden | 405/198 X |

*Primary Examiner*—Tamara Graysay
*Assistant Examiner*—Jong-Suk Lee
*Attorney, Agent, or Firm*—Vinson & Elkins L.L.P

[57] ABSTRACT

A locking mechanism is disclosed for use on the legs of a jack-up offshore platform. Each chord of the legs includes a rack for cooperation with pinions used in raising and lowering the legs. The locking mechanism of the invention includes a rigid frame attached to the hull of the platform and housing a plurality of vertically aligned toothed chock segments adapted to engage the teeth of the rack on a leg. The chock segments have upper and lower inclined surfaces which cooperate with upper and lower movable wedges for supporting the chock segments. The design makes the chock segments sufficiently adjustable for independent alignment and engagement of the teeth of each chock segment with the corresponding teeth of the rack. Dimensional variances in the rack teeth spacing, resulting from manufacturing tolerances, thereby are accommodated and force concentrations between the rack teeth and chock teeth are minimized. Subsequent engagement and retention of the supporting wedges securely locks the chock segments into mating engagement with the rack teeth, to thereby lock the platform legs in place.

19 Claims, 12 Drawing Sheets

JACK-UP PLATFORM LOCKING APPARATUS AND METHOD

BACKGROUND OF THE INVENTION

1. Field of the Invention

This invention relates to the field of leg locking and supporting systems for self-elevating platforms or jack-up rigs of the type used in the offshore exploration and production of hydrocarbons, as well as for other purposes. Offshore platforms have been used extensively by the oil and gas industry in continental shelf regions for oil and gas drilling, production, operations, pipeline pumping stations, personnel accommodations and miscellaneous service and work-over operations.

Fixed offshore platforms, intended to remain in one location, traditionally are built on shore, transported by barge to the offshore location, launched and rotated into an upright position and permanently affixed to the sea floor. Mobile offshore vessels have been developed to meet the offshore industry's needs for a facility from which drilling, production or work-over operations can be conducted and which usually will remain at one location only while operations are conducted, after which it can be moved to a different location. Various types of mobile offshore vessels have been developed to meet the needs of the industry including semisubmersible platforms and floating drill ships for deep water operations, posted barges for inland waters or bayous and jack-up platforms for shallow to moderate water depths.

The usual jack-up offshore drilling rig or platform includes a barge hull and supporting legs which are capable of being operated to raise the hull above the surface of the water. The barge hull may be towed as a floating vessel from one location to another with the legs raised up through the hull. Upon reaching the intended location, the elevating system will lower the legs through the barge hull until firmly engaged with the sea floor. Continued downward jacking on the legs will result in penetration of the legs into the sea floor until a firm foundation for the footings is achieved, after which, continued jacking will cause the hull to lift above the sea surface to a height greater than the anticipated highest wave height during operations.

The elevating systems for jack-up rigs conventionally include three or more legs, each leg consisting of one or more chords, but most typically of three chords. One or more gear racks extend longitudinally along the length of the chords of each leg and are driven by pinion gears attached to the hull and powered by hydraulic, electric or electromechanical means in a manner well known to those skilled in the art. The pinion gears may be arranged such that the pinion teeth face the center of a trussed leg with multiple chords, or they may be oriented as opposed pinions with a toothed rack mounted on each side of a leg or leg chord to engage the opposing pinions. Multiple pinions often are stacked vertically to provide enough force to lift the desired loads.

2. Description of the Related Art

Such jack-up rigs are subject to large environmental loadings from storms which exert wind forces on the platform and wind and wave forces on the legs of the platform. A combination of these forces, together with the heavy weight of the platform, can result in a large interaction force between the platform and the legs which must be resolved at the leg-to-hull interface or connection. To assist in strengthening and rigidifying the leg-to-hull interface, jack-up rigs typically are provided with leg locking systems which are engaged after the platform has been elevated to its desired position or, in some cases, when storm conditions are anticipated. Prior art leg locking systems typically include elongated chocks which have surfaces configured to conform to the teeth on the elongated leg racks. The chocks are positioned vertically so as to mesh with the teeth and then are moved horizontally by means of hydraulic cylinders, screw jacks, electric motors, etc. until they firmly engage a plurality of teeth on each chord of each leg. Various types of mechanical and hydraulic means then are used to lock the chocks into engaged position, so that they serve to lock the legs in position, as well as to rigidify the elevated structure and insulate the pinion gears from stress loading due to storm waves and the like.

A principal problem in such prior art structures relates to the necessity for properly vertically aligning the toothed chocks and the teeth of the racks on the leg chords prior to engaging the chocks. The pinion gears can position the legs vertically. However, since the legs are large, the individual rack teeth at the three leg apexes may vary slightly from each other in vertical relationship to the surface of the hull, due to manufacturing tolerances, imposed loads and similar factors. It is not unusual, with the leg at a set position, for rack teeth at one apex of the same leg to vary vertically, relative to the hull, from those of another apex of the same leg by 1 to 3 inches, plus or minus, over the 12 inch vertical dimension of a typical tooth. Thus, mating engagement of the chocks with the leg rack teeth requires that means be provided for limited vertical adjustment of the individual chocks relative to the platform body, so as to align the teeth of each chock with the teeth of each of the leg racks prior to mating engagement of the chock teeth with the rack teeth. Various prior art leg locking systems have provided this function by including means for vertical adjustment of the chocks relative to their supporting housings or structures mounted on the rig hulls, after which the chocks are locked in their vertical position prior to horizontal engagement of the chock teeth with the rack teeth. With such systems, if the vertical adjustment of the chocks is imprecisely done, a slight vertical misalignment between the chock teeth and leg rack teeth can result, which will produce stress concentrations between partially engaged teeth which greatly reduce the effectiveness of the chocks.

Another problem presented by prior art leg locking devices is their failure to accommodate manufacturing tolerances of leg rack teeth. Most rack teeth for jack-up rig legs are flame cut out of heavy steel plate guided by a physical template or computer control. Cutting heat and subsequent heat treatment can cause distortions, producing teeth which can vary in size by as much as ⅛ inch over a typical 12 inch tooth. Since it is desirable, in leg locking systems, to have the toothed chocks engage at least four teeth of each leg rack, the accumulation of manufacturing tolerance errors over the length of four teeth can be enough to cause improper mating of some of the teeth, again causing stress concentrations which negate the desired even distribution of loading forces over the engaged teeth.

A further problem with most prior art leg locking devices is that the devices, after being exposed to storm loadings, may become jammed and are very difficult to disengage when it is desired to release the leg locking systems.

In addition, some prior art systems rely upon hydraulic forces for retaining the chocks in mating engagement with the leg racks, which creates a risk of disengagement in the event all power is lost on the platform.

SUMMARY OF THE INVENTION

It is, therefore, a principal object of the present invention to provide an improved jack-up platform locking apparatus which will overcome or minimize difficulties inherent in the prior art.

A further object of the invention is to provide an improved jack-up platform locking apparatus which will securely engage the jack-up platform with the legs and which, once engaged, operates independently of the leg jack-up mechanisms and which is simple and reliable to operate and not subject to failure in the event of power loss on the platform.

A further object is to provide such a jack-up platform locking apparatus which provides for vertical adjustment of the chocks relative to the teeth of the racks in a simpler, sturdier and more reliable manner than prior art systems.

A further object is to provide such a system in which a plurality of relatively short vertically aligned chock segments are provided in each chock unit, each engaging preferably not more than two consecutive teeth of the corresponding leg rack, so as to minimize the effect of tolerance variations in the flame cut teeth of the leg racks.

A further object is to provide such a system which utilizes hydraulically actuated support wedges for positioning and supporting the chock segments horizontally and vertically for mating engagement with the rack teeth and which utilizes self-locking horizontal screw mechanisms for mechanically locking the supporting wedges and chock segments in the engaged position, so as to minimize or eliminate reliance upon hydraulic pressure for maintaining the system in locked position.

A still further object is to provide such a system in which the support wedges and chock segments can be quickly and easily disengaged, without the risk of binding inherent in prior art systems.

BRIEF DESCRIPTION OF THE DRAWINGS

These and other objects and advantages of the present invention will be apparent from the following detailed description of a preferred embodiment thereof, taken in conjunction with the accompanying drawings wherein.

DESCRIPTION FO THE PREFERRED EMBODIMENTS

The leg locking system of the present invention uses a plurality of vertically aligned toothed chock segments disposed longitudinally of each leg rack. Each of the chock segments is relatively short in longitudinal dimension, preferably engaging not more than two teeth of the leg rack. The toothed chock segments have inclined upper and lower bearing surfaces which engage conforming wedges which support the chock segments. The support wedges permit horizontal and vertical adjustment of the chock segments, to conform to the horizontal and vertical position of the corresponding rack teeth to be engaged by the chocks. Double acting hydraulic cylinders are provided for moving the rack chock segments and their supporting wedges into alignment and mating engagement with the corresponding rack teeth. Mechanical screw means with self-locking threads are provided for locking the engaged system in place, independent of hydraulic pressure.

Utilizing a plurality of short, independently adjustable, rack chock segments, each engaging preferably not more than two teeth of the leg rack, makes possible the engagement of four or more teeth of the leg rack by aligned rack chock segments, while limiting the effect of dimensional variances in individual rack teeth. Utilizing wedges for horizontal and vertical adjustment and support of the rack chock segments reduces the risk of the parts binding and locking due to imposed loading during use of the system, as well as reducing the force necessary for unlocking the system and returning the parts to stowed position when it is desired to release the rig legs.

Figure 1:
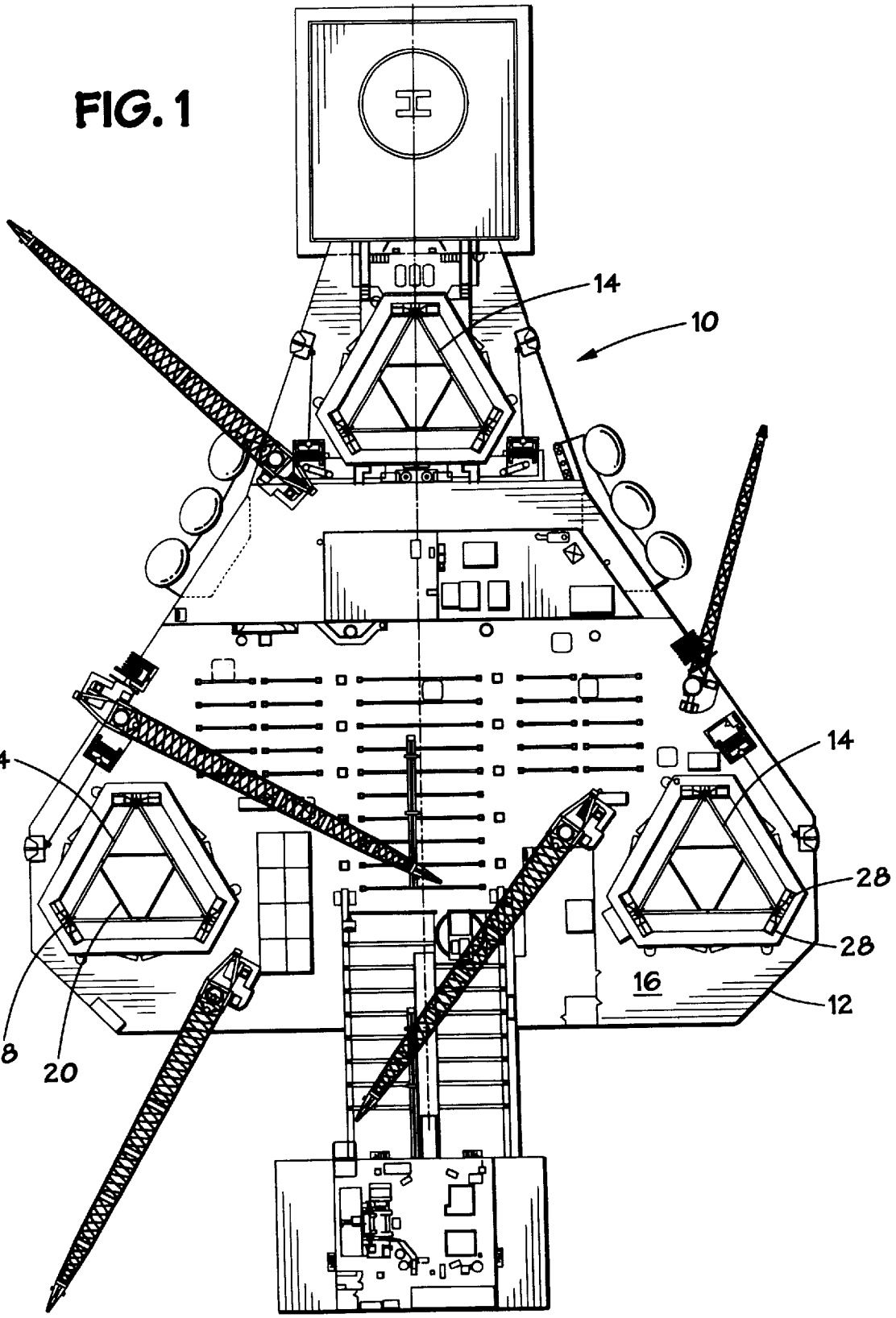
FIG. 1 is an illustration in plan view of a jack-up rig of the type on which the leg locking system of the present invention might be used, illustrating the three triangular jack-up legs, and the placement of the leg racks and pinion jacking systems used for raising and lowering the legs relative to the body of the rig.
Figure 2:
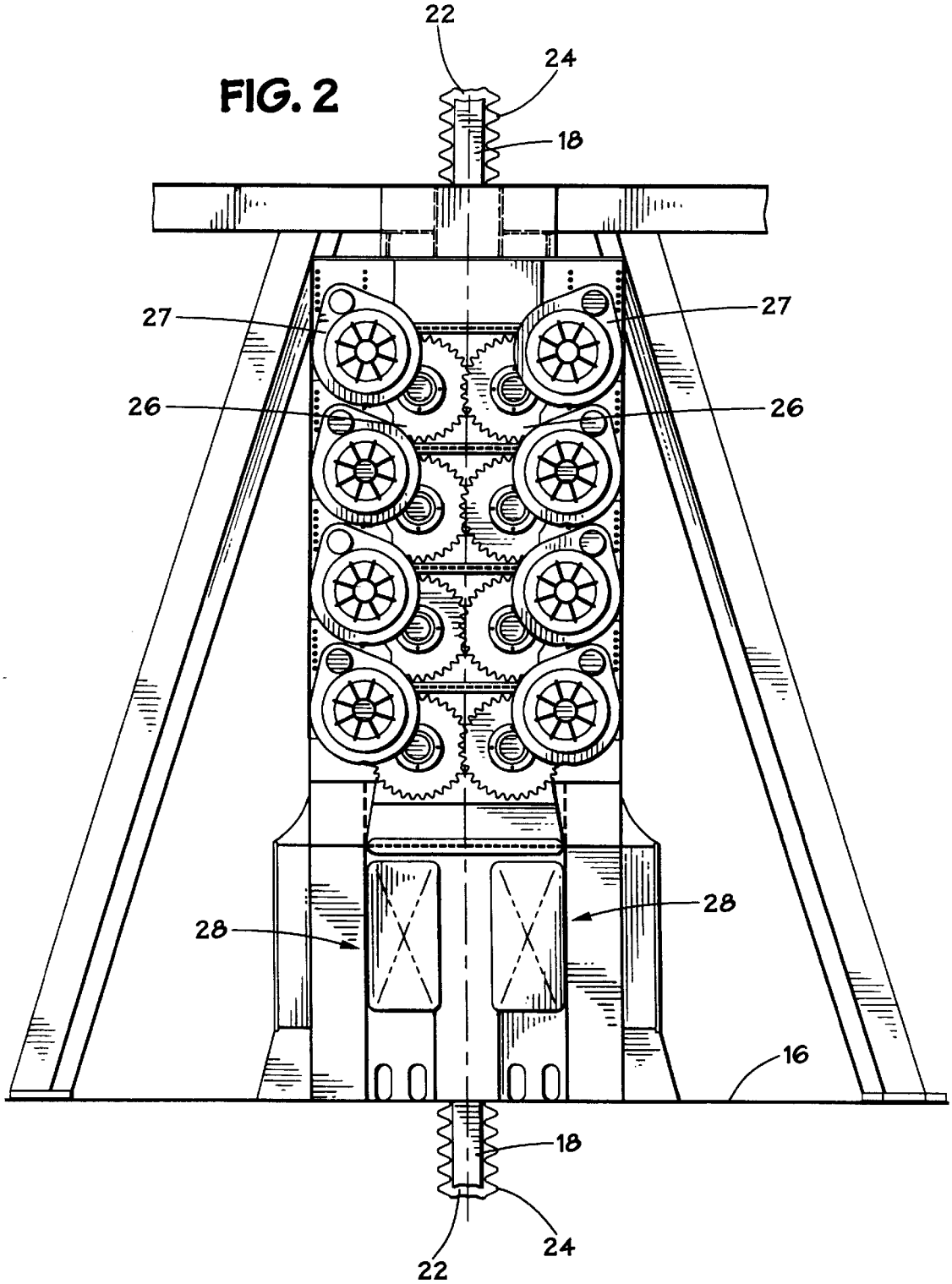
FIG. 2 is a fragmentary view, in elevation, of one chord of a leg of the jack-up rig of FIG. 1, illustrating the relative positions of the elongated toothed gear racks on the leg chords, the jack-up pinions and the leg locking units in accordance with the present invention.

FIG. 1 depicts, in plan view, an offshore jack-up platform of the general type which advantageously may utilize the leg locking mechanism of the subject invention. The platform 110 comprises a buoyant barge hull 12 which may be self-propelled or towed to a desired location. The hull serves to support and transport a plurality of platform legs 14 which, in the illustrated embodiment, comprise three triangular platform legs. The deck 16 of the platform is fitted with the usual accompaniment of offshore drilling and/or production equipment such as a derrick, draw works, pipe racks, mud processing units, crew quarters, heliport, lifting cranes, etc. Each of the three corners of the platform is fitted with a vertical well extending through the hull which serves to guidingly receive one of the platform legs 14. Each of the three platform legs comprises three vertically extending chords 18 which are structurally tied together and united by lateral bracing 20 in suitable configuration.

When the platform is being moved from one location to another, the legs are carried in raised position. The legs may be segmented, with leg segments being carried on the deck and then aligned and attached to lower leg segments when it is desired to lengthen the legs.

Once the platform reaches its desired location for operations, the hull is elevated above the surface of the water by jacking the leg segments down until they reach the ocean floor. Once the supports on the bottom of each leg penetrate to sufficient load bearing strata, continued jacking of the leg units will raise the platform above the water to its desired operating height where the hull will be free from engagement with the highest anticipated storm waves.

One type of commonly used leg jacking mechanism, for which the subject invention is particularly useful, is known as a rack and pinion jacking system. In this system, each chord of each leg includes a longitudinally extending double sided toothed rack 22 with a plurality of flame cut teeth 24. Opposed pinion gears 26 engage each side of each leg rack and matingly engage the rack teeth. Hydraulic or electric drive mechanisms 27 carried by the platform power the pinion gears for rotation in the desired direction to raise or lower the platform legs relative to the hull of the platform.

Once the platform is at its desired elevation above the water, operation of the pinions is discontinued. The pinion drive systems are of self-locking design, so that they will maintain the platform in the desired elevated position. A plurality of leg locking units 28, in accordance with the present invention, also are carried by the platform. Each unit includes two vertically aligned gear chock segments, each of which has two teeth shaped to conform to the teeth of the longitudinal leg rack. When the toothed chock segments are matingly and rigidly engaged with the leg racks, as described hereinbelow, they serve to lock the leg against longitudinal movement relative to the platform hull and also protect the pinion gears from excessive loading, binding, deformation, etc. due to extreme conditions encountered during storms.

Figure 4:
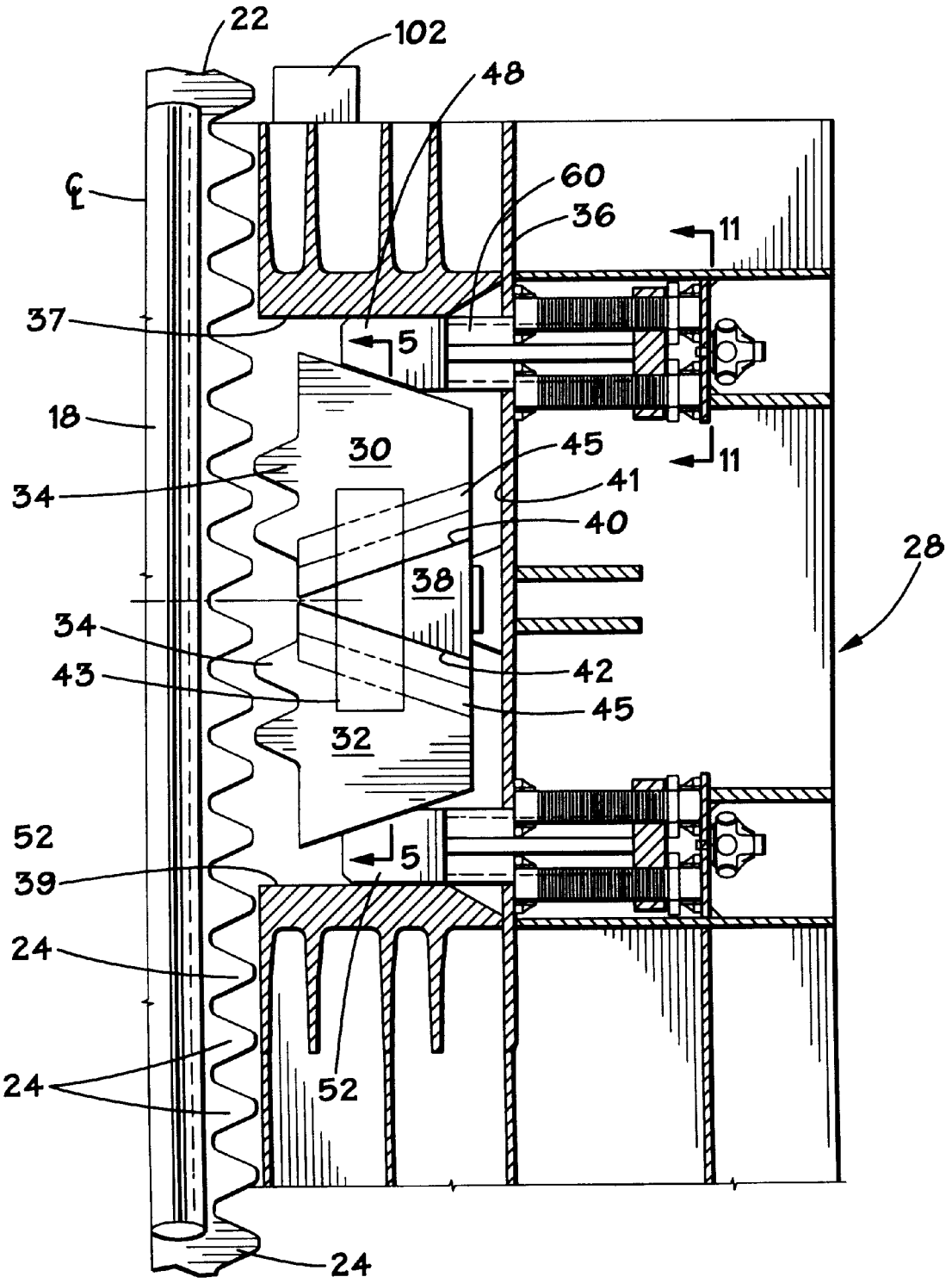
FIG. 4 is a view in side elevation and partly in section of the unit of FIG. 3, illustrating the toothed chock segments and support wedges used for vertical and horizontal positioning and support of the chock segments, with the chock segments being illustrated in a stowed position, not engaging the teeth of the leg rack.
Figure 6:
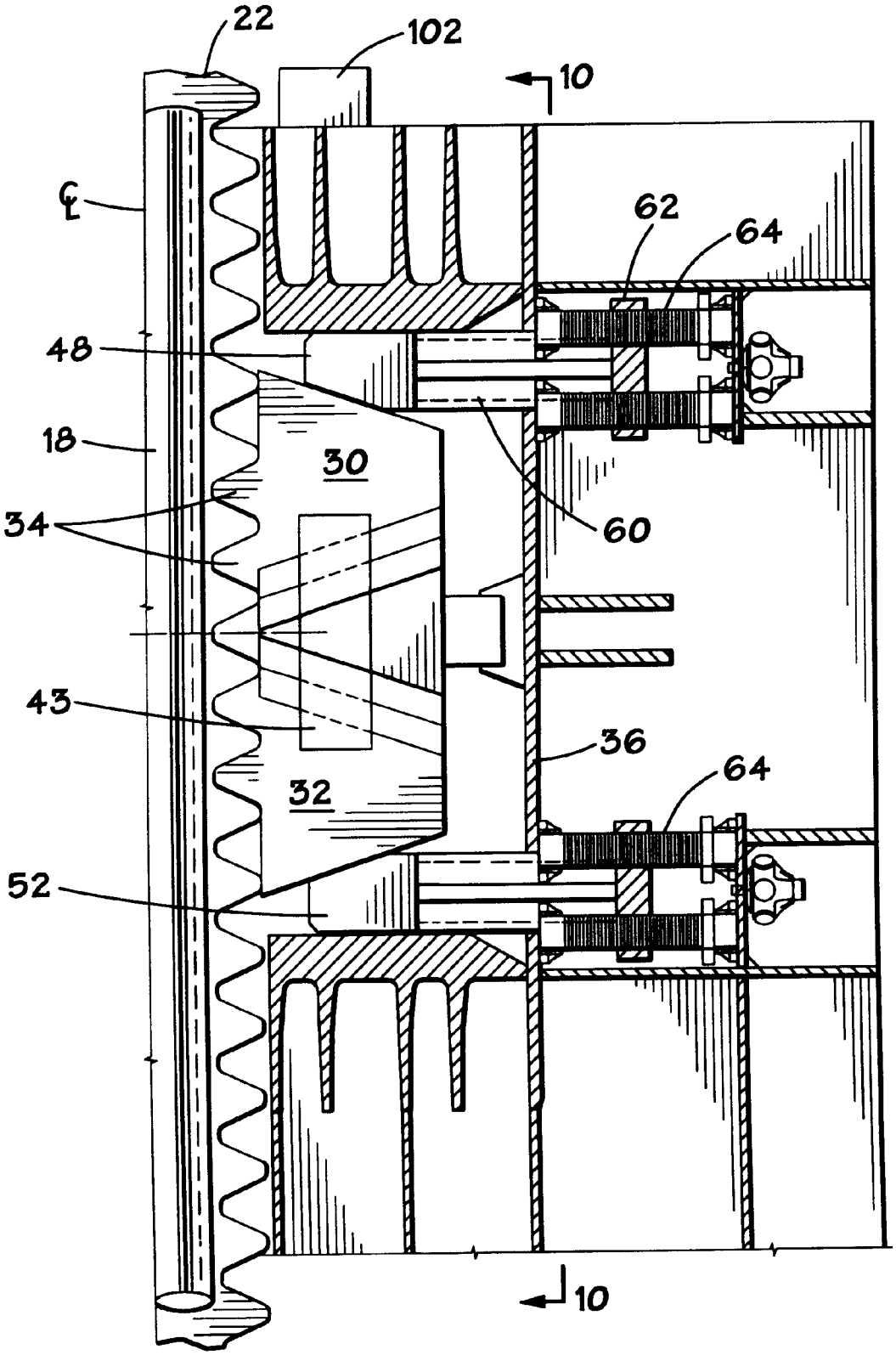
FIG. 6 is a view similar to FIG. 4, but showing the toothed chocks deployed to engage the teeth of the leg rack.

Referring now to FIG. 4, there is illustrated in elevation, and partly in section, a single leg locking unit 28 in opposed relationship to one side of a longitudinal leg rack 22. At least one such leg locking unit would be disposed on each side of each longitudinal leg rack. A three leg jack-up, having triangular legs, thus would require eighteen such units. The parts are illustrated in the relative positions they would assume in stowed position (FIG. 4) and in deployed, locked position (FIG. 6).

Each leg locking unit includes a rigid housing 36 carried by the hull and adapted to suitably support and guide the movable parts of the unit. Upper and lower horizontal bearing surfaces 37, 39, respectively, rear wall 41 and opposed sidewall portions (not shown) define a central opening in the housing 36 into which are recessed the active elements of the locking system.

These comprise a first, or upper, chock segment 30 with two teeth 34 and a second, or lower, chock segment 32 with two teeth 34. The upper and lower chock segments are separated by an intermediate, triangular shaped, support wedge 38. Support wedge 38 acts as a double wedge, engaging both the conformingly shaped lower inclined surface 40 on chock segment 30 and the upper inclined surface 42 on chock segment 32. The upper and lower chock segments 30, 32 and intermediate support wedge 38 are made of suitably thick high-strength steel so that they are able to withstand the heavy mechanical loads imposed on the locking system by the legs of the platform 10. The preferred slope between the inclined surfaces 40, 42 on the chock segments and the double support wedge 38 is such that the wedge and chocks are substantially self-locking in an unloaded condition.

Figure 5:
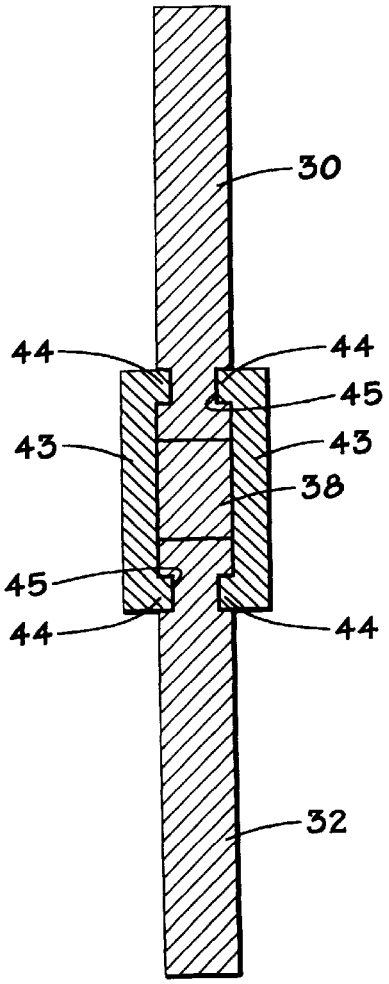
FIG. 5 is an enlarged detail sectional view, taken along line 5-5 of FIG. 4, and illustrating details of the guide means for interconnecting the upper and lower toothed chock segments.

Anti-rotation guide means may be provided for slidably interconnecting the upper and lower chock segments 30, 32. As shown in FIGS. 4 and 5, these comprise a pair of elongated guide members 43, one disposed on each side of upper and lower chock segments 30, 32 and bridging the center wedge 38. Each of the guide members 43 has upper and lower inclined guide surfaces on shoulders 44, which engage, and are guided by, conformingly shaped inclined guide slots 45 on the chock segments. Although not shown, the guide members 43 are retained against outward displacement from the guide slots 45 by sliding engagement with portions of the chock unit housing. The guide members 43 act as idlers in the slots 45, so that as the chock segments 30, 32 move vertically toward or away from each other, guide members 43 will move horizontally as required to accommodate such vertical movements of the chock segments. Engagement of the guide surfaces on the shoulders 44 with the guide slots 45 provides an additional moment lock for the chock segments, preventing any significant rotation of the chock segments relative to each other and providing additional rigidity and strength to the overall structure.

Upper and lower support for the chock segments 30, 32 is provided by additional support wedges interposed between the chock segments and the unit housing. The top of upper chock segment 30 is formed by a downwardly inclined surface 46. It is engaged by the conformingly shaped lower surface of a first, or upper, support wedge 48, which is confined between the upper surface of chock segment 30 and upper horizontal bearing surface 37 forming the top of the housing opening. An upwardly inclined surface 50 on the bottom of lower chock segment 32 engages a second, or lower, support wedge 52, confined between the bottom of chock segment 32 and the lower horizontal bearing surface 39 of housing 36. Again, while any desired slope may be used, the slopes between the chocks and the upper and lower support wedges preferably are such that the parts are substantially self-locking in an unloaded condition.

As will be apparent to those skilled in the art, the three support wedges 38, 48 and 52 permit both vertical and horizontal adjustment and support of the chock segments 30, 32. Chock segments 30, 32, with their opposed inclined surfaces, also function as wedges, confined between the opposing wedge surfaces on supporting wedges 38, 48, and 52. As explained more fully below, this arrangement makes possible substantially infinite horizontal and vertical adjustment of the chock segments 30, 32, within the parameters of the system dimensions, so as to assure an accurate mating fit between the teeth of the chock segments and the corresponding teeth of the leg rack 22. However, once the teeth of the chock segments are mated with the teeth of the leg rack (FIG. 6) and the wedges 38, 48, 52 are engaged with their respective cooperating surfaces on the chock segments and retained against movement in a direction longitudinally away from the leg rack 22, then the entire system is locked rigidly and securely in place and the leg rack 22, cannot move vertically with respect to the chock unit until the wedges 38, 48 and 52 are released.

Figure 3:
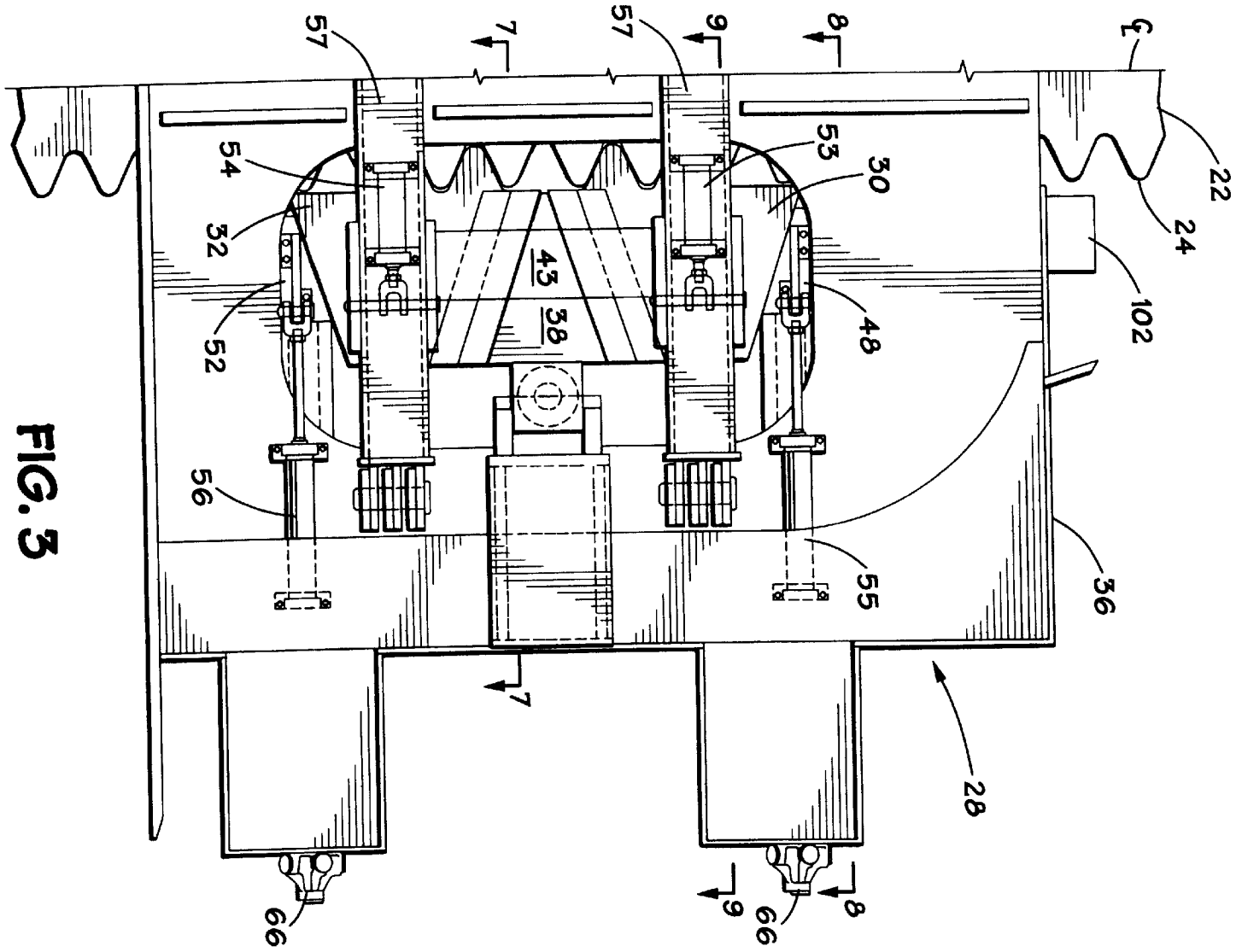
FIG. 3 is a view in side elevation showing one half of one unit of the leg locking system in accordance with the present invention engaging the rack teeth on one chord of a leg of the platform.
Figure 8:
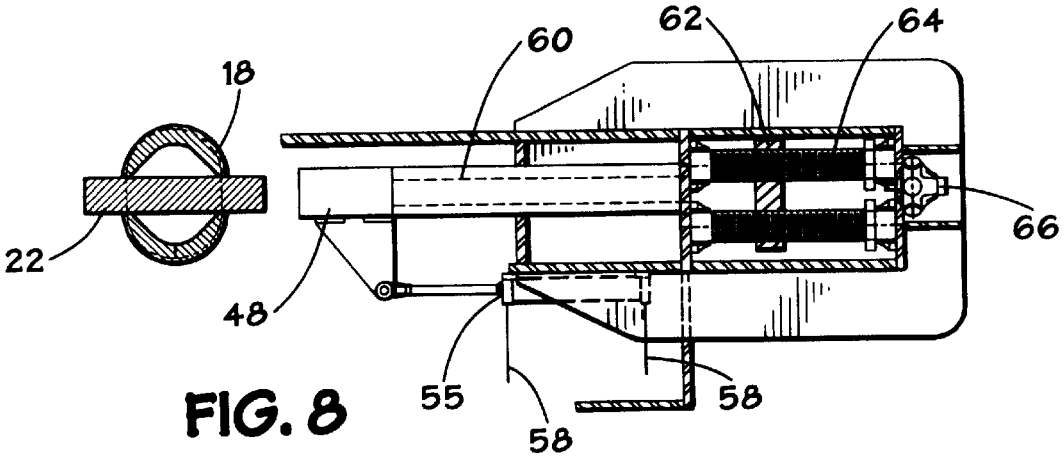
FIG. 8 is a fragmentary view, partly in section, taken generally along lines 8—8 of FIG. 3 and illustrating details of the hydraulic and mechanical system for positioning and locking into deployed position one of the support wedges of the system.
Figure 9:
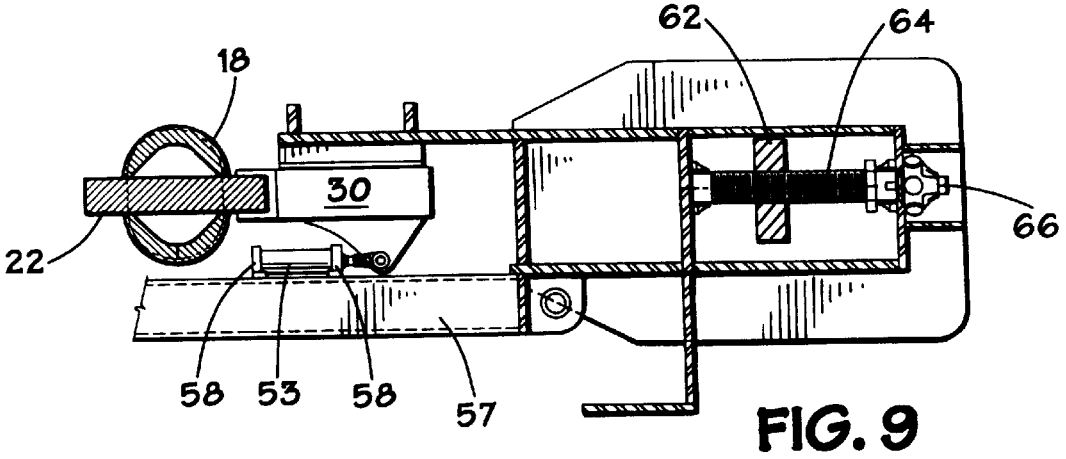
FIG. 9 is a fragmentary view, partly in section, taken along lines 9—9 of FIG. 3 and illustrating details of the hydraulic system for positioning one of the toothed chock segments of the system.

Positioning means are provided for moving the upper and lower chock segments 30, 32 and support wedges 48, 52 horizontally within the unit housing 36 between stowed and deployed positions. In the preferred embodiment, these comprise two double acting hydraulic cylinders 53, 54 each having its piston end attached to one of the chock segments and its cylinder end attached to a box beam 57 forming part of the unit housing (FIGS. 3, 9). Positioning means for moving the upper and lower support wedges 48, 52 horizontally within the housing comprise a second pair of double acting hydraulic cylinders 55, 56 each having its cylinder end attached to the unit housing and its piston end attached to, respectively, one of the upper and lower wedge blocks 48, 52 (FIGS. 3, 8). The double acting cylinders 53, 54, 55, 56 preferably are slidably or pivotally mounted in such a manner that vertical adjustment of the chock segments and support wedges up or down at least three inches relative to the chock unit housing is possible without binding the cylinders. Hydraulic lines 58 provide means for supplying hydraulic fluid under pressure to either end of the double acting cylinders, while simultaneously draining hydraulic fluid from the other end of the cylinder, so as to cause a piston (not shown) in the cylinder to move the attached chock segment or wedge block horizontally toward or away from the leg rack 22. A conventional hydraulic power unit 61 has conventional control means (not shown) for selectively supplying hydraulic fluid under pressure to either side of each of the cylinders so as to effect the desired horizontal movement of the chock segments or wedge members. For simplicity of illustration, all hydraulic lines are numbered "58" and only a single hydraulic power source 61 is indicated. However, it will be understood that separate hydraulic lines are supplied to each side of each double acting cylinder and that one or more sources of hydraulic power and associated control means may be provided for powering and controlling each of the locking units 28 separately, or for controlling two or more of the units simultaneously, as desired. Threaded, electric, pneumatic, etc., positioning means could, of course, be substituted for the hydraulic means disclosed.

Figure 11:
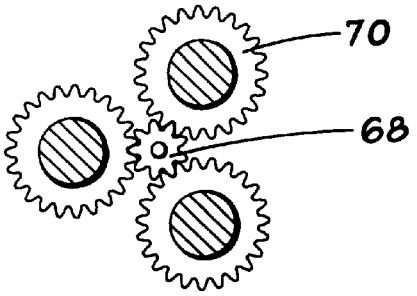
FIG. 11 is a fragmentary view, taken along a line 11—11 of FIG. 4, and illustrating details of the gearing arrangement for the threaded wedge retaining apparatus of FIGS. 8–10.
Figure 10:
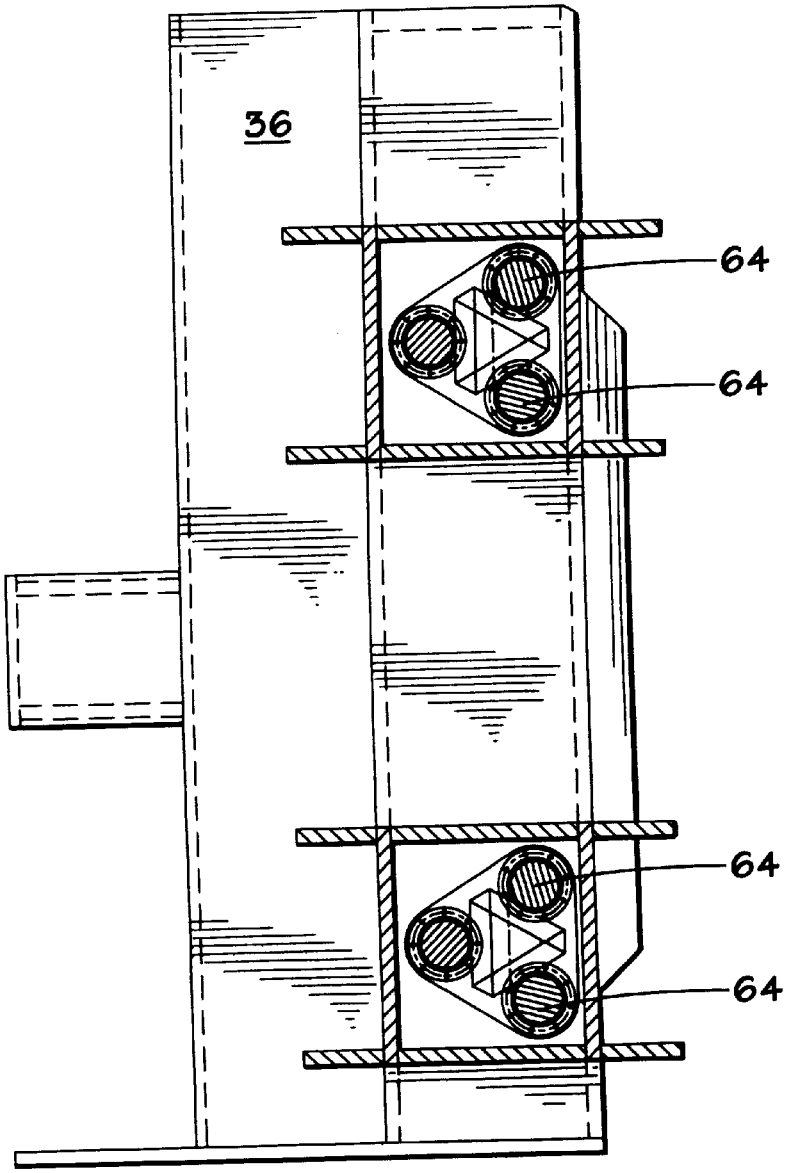
FIG. 10 is a view in elevation and partly in section taken along line 10—10 of FIG. 6 and illustrating additional details of the threaded wedge retaining apparatus of FIGS. 8, 9.

Retaining means are provided for selectively retaining the three support wedges, once deployed, against horizontal movement in a direction away from leg rack 22. As shown in FIGS. 4 and 6, an elongated hollow tubular spacer 60 is attached to, and moves horizontally with, each of the upper and lower wedges 48, 52. Referring to the upper wedge 48, its associated spacer 60 extends between the back of the wedge and a threaded platten 62, which threadedly engages three elongated rods 64 rotatably mounted in the chock unit housing 36. A reversible hydraulic motor 66 drives a central gear 68 (FIG. 11) which in turn drives three larger gears 70, one on top of each of the threaded rods 62 (FIG. 11), so as to provide for synchronized rotation in either direction of the three threaded rods Since the platten 62 is threadedly engaged with all three of the rods 64, rotation of the rods 64 in one direction will cause the platten 62, spacer 60 and upper wedge 48 to move horizontally toward leg rack 22, while rotation of the threaded rods in the opposite direction will move the platten 62 horizontally away from leg rack 22, permitting the spacer 60 and wedge 48 to be moved horizontally away from the gear rack by double acting cylinder 55. Suitable means are provided for selectively supplying hydraulic fluid under pressure to the reversible hydraulic motor 66 for selectively rotating the threaded rods 64 in either direction. Although not shown, such means may comprise fluid hydraulic lines extending between the reversible hydraulic motor and the hydraulic power unit 61 and control means (not shown) in the hydraulic power unit for selectively supplying pressurized hydraulic fluid to either side of the reversible hydraulic motor 66, as desired. Identical threaded support means are provided for the lower wedge block 52.

Retaining means for the double acting center support wedge 38 comprise a fifth double acting hydraulic cylinder 72 (FIG. 7) which powers a locking wedge 74 attached to the piston rod of the double acting cylinder 72. Locking wedge 74 engages a shoe 76 affixed to the unit housing 36. Shoe 76 has an inclined surface 78 which cooperates with inclined surface 80 on the wedge 74, while the opposed flat surface 82 on wedge 74 engages the back edge 84 of center support wedge 38, to retain the wedge 38 in its deployed or locked position. The respective inclines on the shoe 76 and 80 on wedge member 74 are sufficiently shallow that the wedge surfaces are substantially self-locking. This means that little, if any, force from cylinder 72 is required to maintain wedge 74 in place when the system is in its deployed, locked condition. A suitable mechanical locking mechanism for this wedge also may be employed. Alternate designs for the retaining means could be used, the desired function being to support and lock the three support wedges in their deployed positions.

Figure 7:
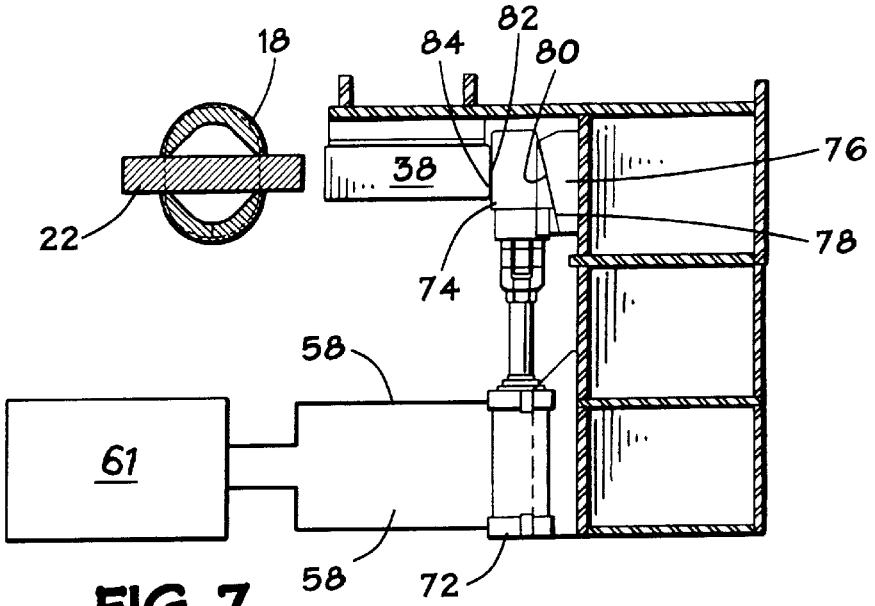
FIG. 7 is a fragmentary view, partly in section, taken generally along lines 7—7 of FIG. 3 and illustrating details of the locking wedge and shoe arrangement for locking the central support wedge of the system into engaged position.
Figure 15:
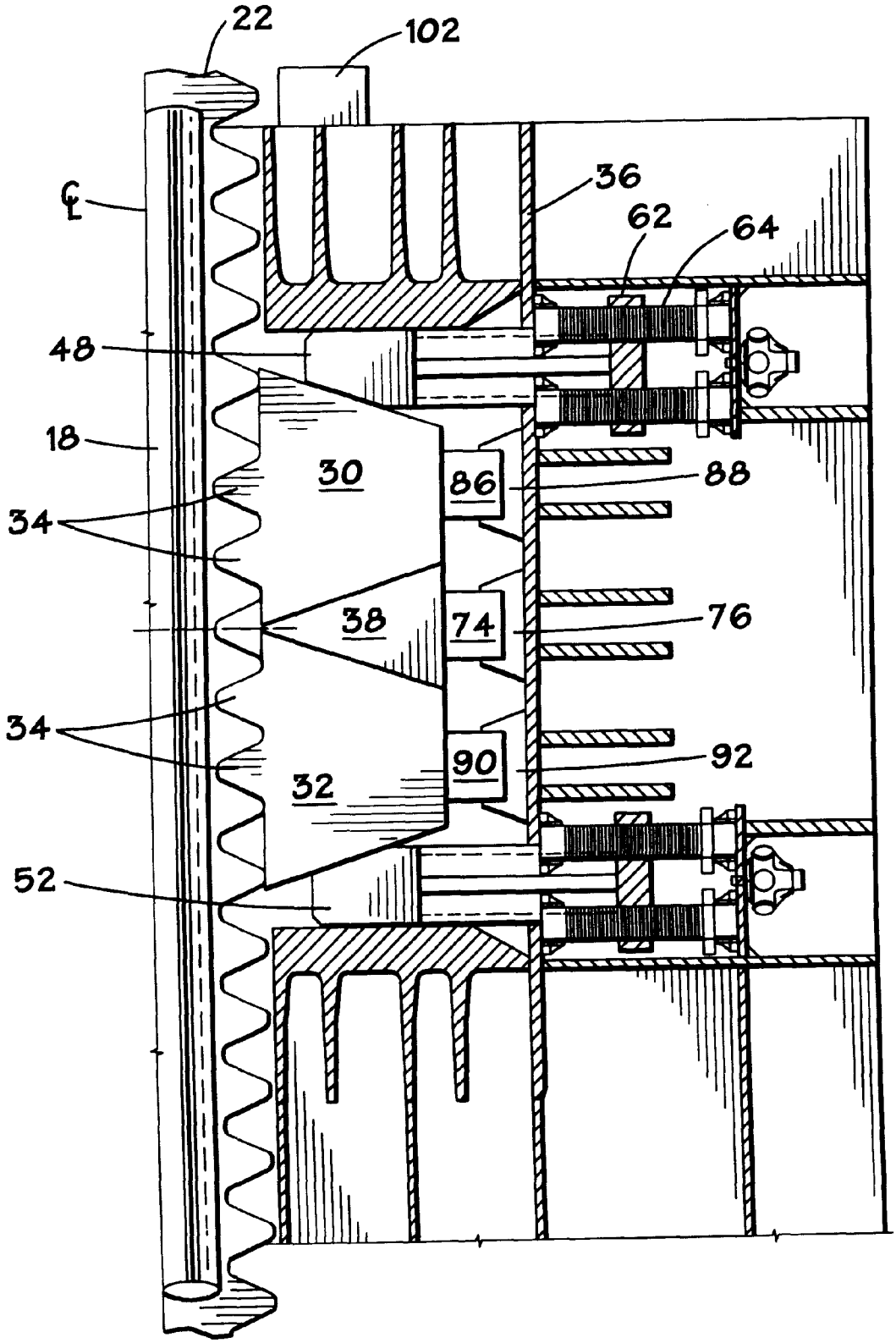
FIG. 15 is a view similar to FIG. 6, but illustrating the upper and lower toothed chock segments, as well as the intermediate support wedge, being provided with back-up locking wedges.

FIG. 15 illustrates an alternate embodiment of the leg locking device of the present invention in which upper and lower chock members 30, 32 also are provided with back-up locking wedges. As shown, upper locking wedge 86 is disposed between the back of upper chock segment 30 and shoe 88 carried by the unit housing, while lower locking wedge 90 is disposed between the back of lower chock segment 32 and shoe 92 in the unit housing. Each of the additional locking wedges 86, 90 is activated by an additional hydraulic cylinder (not shown) as disclosed above in connection with the center locking wedge 74 (FIG. 7). The manner of operation of the additional locking wedges 86, 90 is the same as that disclosed for the center locking wedge 74. If back-up locking wedges are provided for each of the upper and lower chock segments and center support wedge 38, then the provision of additional anti-rotation guide means for the chock segments, such as elongated guide members 43, generally would not be used and therefore are not shown in FIG. 15.

Figure 14:
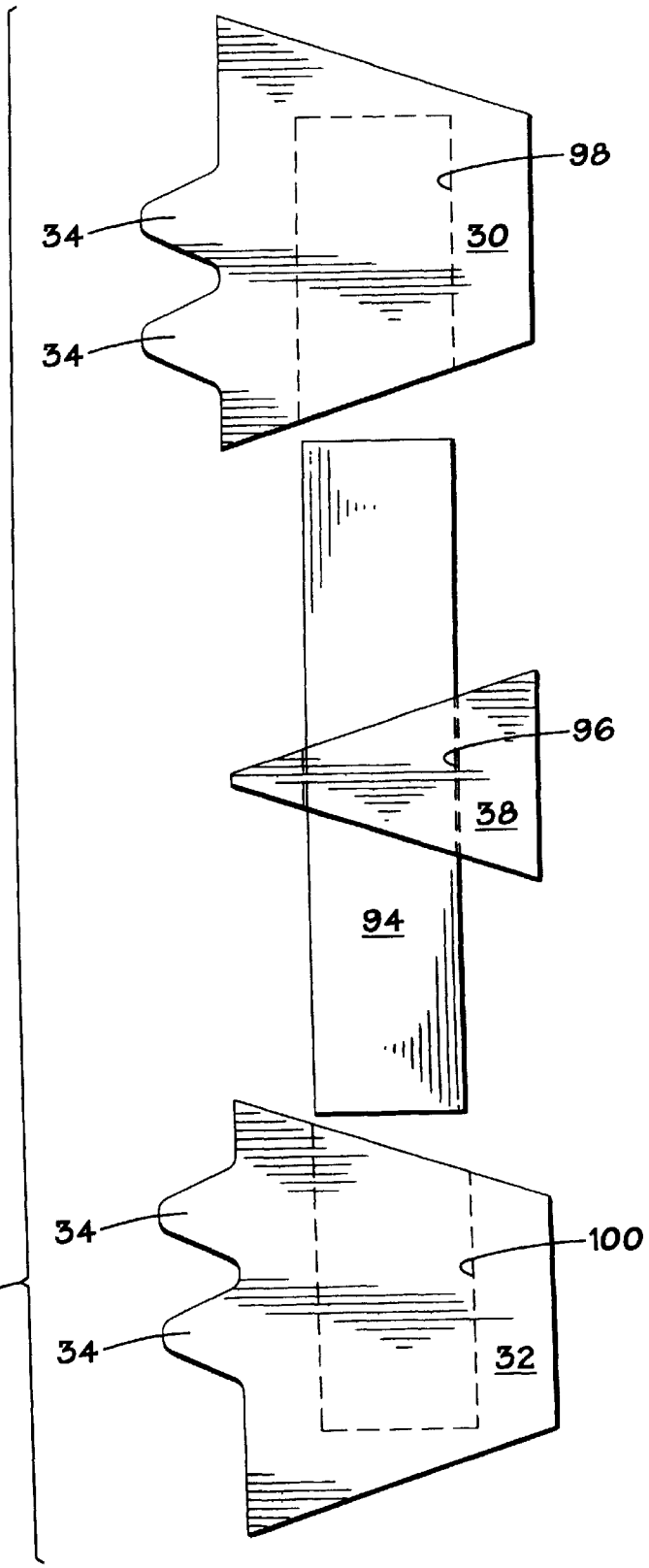
FIG. 14 is a simplified illustration in exploded view of an alternate guide means for interconnecting the upper and lower toothed chock segments and the intermediate support wedge segment of the system.

Referring to FIG. 14, there is disclosed another alternate embodiment of the anti-rotation guide means for the upper and lower chock segments 30, 32. As there shown in exploded view, a vertical guide bar 94, which preferably is of generally rectangular cross-sectional configuration, is slidably received in a conformingly shaped passageway 96 formed vertically through the body of intermediate support wedge 38. The upper and lower ends of guide bar 94 are adapted to be slidably received in conformingly shaped substantially vertical recesses 98, 100 formed in the bodies of, respectively, upper chock segment 30 and lower chock segment 32. Clearances between the slidingly engaged pieces preferably allow adequate independent adjustment of the upper and lower chock segments 30, 32 and center support wedge 38 relative to each other and relative to the teeth of leg rack 22 so as to permit the teeth of the chock segments to fully matingly engage corresponding teeth on the leg rack, while accommodating manufacturing tolerances in the rack teeth. Guide bar 94 assures, however, that the intermediate support wedge 38 will move horizontally with the upper and lower chock segments 30, 32 and additionally serves as a moment lock, preventing any significant rotation of the chock segments relative to each other.

Figure 16:
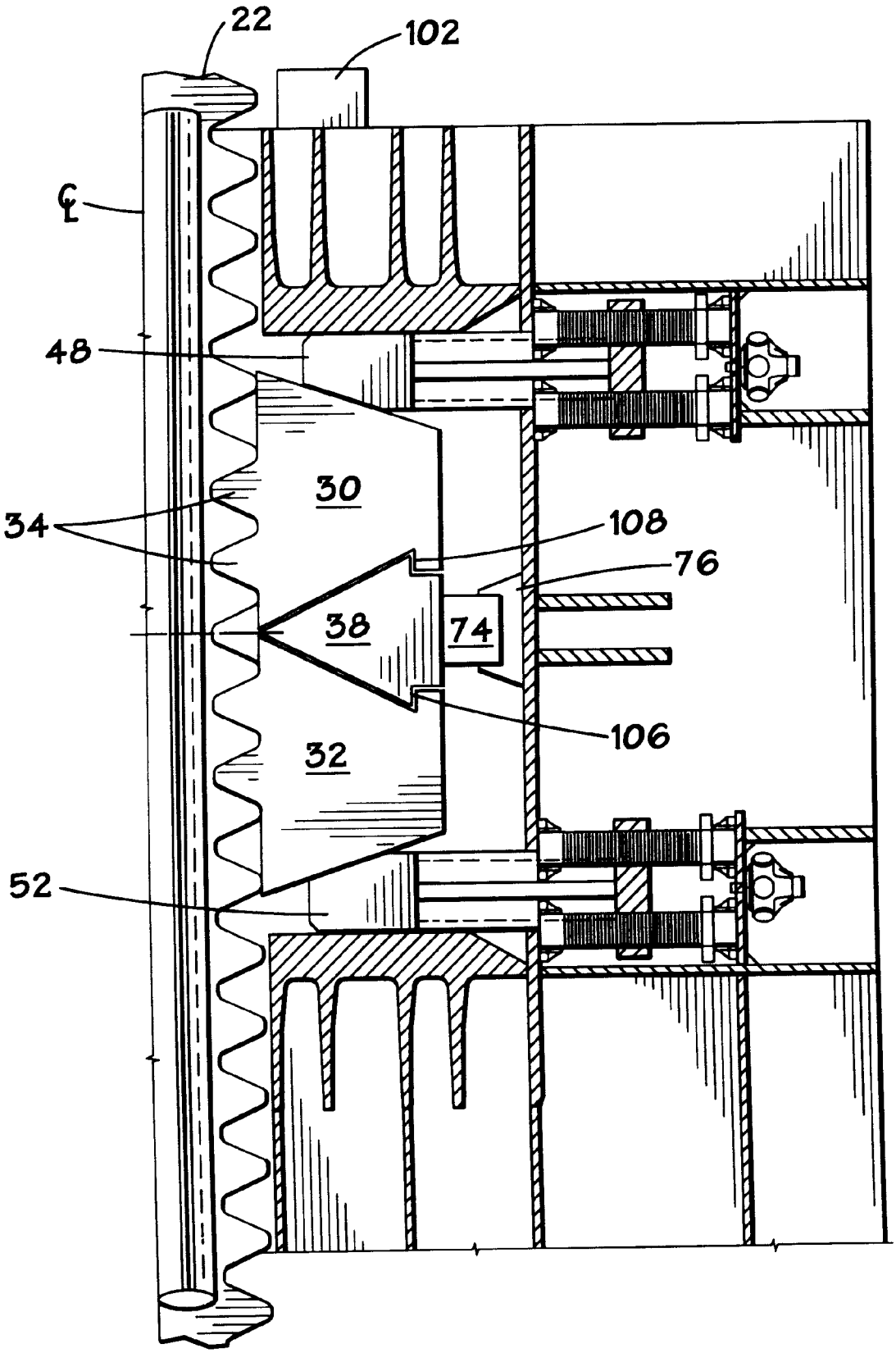
FIG. 16 is a view similar to FIG. 6, but illustrating an alternate configuration for the intermediate support wedge and in which the anti-rotation guide means shown in FIGS. 3–6 has been eliminated.

Referring to FIG. 16, there are shown alternate configurations for the upper and lower chock segments 30, 32 and the central support wedge 38. The changes comprise the provision of opposed shoulders 106 on the double wedge 38 and 108 on each of the upper and lower chock segments 30, 32. These opposed shoulders serve to retain the double wedge against displacement rearwardly of the chock segments, so that the two chock segments and the double wedge will move generally as a unit. However, the double wedge 38 preferably is somewhat smaller than the space between the chock segments, so that the double wedge and chock segments have freedom for limited lateral and vertical movement with respect to each other. This enables the system to accommodate minor dimensional variances between the two rack teeth engaged by the upper chock segment 30 and the two rack teeth engaged by the lower chock segment 32, so as to better equalize the distribution of force between the leg rack and chocks. in the embodiment shown in FIG. 16, neither the elongated guide member 43 of FIGS. 3 through 6, the central vertical guide bar 94 of FIG. 14, nor the additional back-up locking wedges of FIG. 15 are illustrated as being present. Of course, any of such supplemental anti-rotation means could be utilized with the configuration of FIG. 16, if desired.

When the system is in its stowed position (FIG. 4), chock segments 30, 32 are centered in the opening of housing 36. In this position there preferably is at least approximately a 3 inch clearance between the upper housing surface 37 and the top of chock segment 30 and at least approximately a 3 inch clearance between the lower housing surface 39 and the bottom of chock segment 32. As explained more fully hereinafter, this permits approximately a 6 inch overall vertical adjustment (plus or minus approximately 3 inches from the centered position) of the chock segments, so as to accommodate misalignment between the chock teeth 34 and the leg rack teeth 24. The longitudinal center lines of the chock segments 30, 32 and wedges 38, 48, 52 preferably are substantially aligned with the longitudinal center line of the leg rack 22. Hydraulic cylinders 53, 54, 55, 56 are pressurized in a direction to hold the parts in their retracted, stowed position or mechanical locking mechanisms such as retaining pins (not shown) are provided for the chock segments, so that the teeth of the chock segments do not engage the teeth of the leg rack. If secured hydraulically, means preferably are provided for maintaining some pressure on the cylinders while the parts are in their stowed position. This may comprise control means (not shown) in the hydraulic power unit 61 for isolating the cylinders and their associated hydraulic lines, so that pressure is maintained at an appropriate level on the appropriate sides of the cylinders to securely maintain the parts in their retracted, stowed positions. A pressure accumulator (not shown) also could be provided in the hydraulic system for that purpose. Hydraulic cylinder 72 and its associated wedge 74 are retracted and inactive. The plattens 62 are retracted on their threaded rods 64 to permit retraction of the upper and lower support wedges 48, 52 and their associated spacers 60.

When engagement of the locking system is desired as, for example, when storm conditions are anticipated, the three chords on each leg preferably are "chocked" one at a time. Selecting the chord to be chocked first, the vertical position of the leg rack and the chock system for that chord are aligned by operating the pinion gears 26 to substantially align the teeth on the leg rack 22 for mating engagement with the teeth on the chock segments for the corresponding chock unit. This can be done manually or, preferably, by means of vertical alignment sensors 102 mounted on the platform hull. One such sensor is provided for each leg on the platform and preferably is positioned on or near the chord for that leg which is to be chocked first. The sensors, which are of conventional design, are adapted to stop elevation of the platform relative to the leg at a preselected point where the teeth on the leg rack of that leg chord will be substantially aligned for mating engagement with the teeth on the centered, stowed chock segments of the two chock units for that leg chord. While any desired type of vertical alignment means or sensors may be used, a preferred type are proximity sensors in which a proximity meter carried by the hull senses the proximity of each tooth crest as it passes the meter, so that tooth crests can be counted and accumulated to thereby permit automatic elevation of the platform to a pre-selected vertical position on the legs. Operation of the pinions then can be stopped at a point where a tooth crest is substantially directly opposed to the proximity meter, so as to assure substantial vertical alignment of the other rack teeth with the centered chock teeth of the chock unit. While substantial alignment is desired, the chock unit will accommodate misalignment up to the limits designed into the system which, for the illustrated preferred embodiment, is plus or minus approximately 3 inches.

Once the leg has been suitably positioned, cylinders 53 and 54 are supplied with pressurizing fluid in a direction to cause the two chock segments 30, 32 to move toward the leg rack until the teeth of the chock segments engage the teeth of the leg rack. Double support wedge 38 will advance along with the chock segments 30, 32.

As the chock segments 30, 32 advance toward the rack teeth, they will move down slightly, responsive to the slope between lower chock segment 32 and lower support wedge 52. Once the chock teeth engage the rack teeth, continued pressure from cylinders 53, 54 urging the chock segments toward the rack will cause the chock teeth to slide upwardly and inwardly on the slope of the rack teeth 24 until a near perfect fit is achieved between the leg rack teeth 24 and the chock segment teeth 34. The fact that the two chock segments 30, 32 have some degree of movement independently of each other, within the tolerances of the interconnecting guide means, if used, permits a more perfect mating of the chock teeth with the leg rack teeth than would be possible for a single chock segment with four teeth. The effect of manufacturing dimension errors on the flame cut rack teeth therefore is limited to a two-tooth range, rather than accumulating over the vertical distance of four rack teeth.

With the chock segments continuing to be held in close mating engagement with the rack teeth by cylinders 53, 54, cylinders 55, 56 are supplied with pressurizing fluid in a direction to cause the two support wedges 48, 52 to move into firm supporting engagement with the chock segments. This completes the basic alignment engagement process.

With the parts in their engaged position, cylinder 72 is pressurized in a direction to force the intermediate locking wedge 74 against the inclined surface of shoe 76, locking the intermediate support wedge 38 firmly in place. Upper and lower locking wedge blocks 86, 90, if used, are similarly engaged. Hydraulic motors 66 next are used to move the platten 62 on threaded rods 64 into contact with the hollow spacers 60. This firmly locks the upper and lower support wedges 48, 52 in place, thus preventing disengagement of the chock segments 30, 32 from the leg rack teeth. Self-locking threads between the platten 62 and threaded rods 64 prevent disengagement until the rods are rotated by motor 66 in the opposite direction. The pressure then may be released from cylinders 53, 54, 55 and 56, since they no longer perform any retaining function. While not absolutely necessary, it is desirable to keep some pressure on cylinder 72, as well as the cylinders for upper and lower locking wedge blocks 86, 90, if used, to retain the locking wedge blocks in place. Since only minimal pressure is needed, this can be accomplished by adjusting control means (not shown) in the hydraulic power unit 61 so as to lock the pressurizing fluid into the cylinders. Alternatively, passive accumulator means may be provided for retaining pressure on the locking wedge cylinders, even if all power from the hydraulic power unit 61 is interrupted. Alternatively, a mechanical locking device may be used for this same purpose.

The steps just described will be performed sequentially on each of the chock units on each chord of each platform leg to securely lock the platform legs in place.

Figure 12:
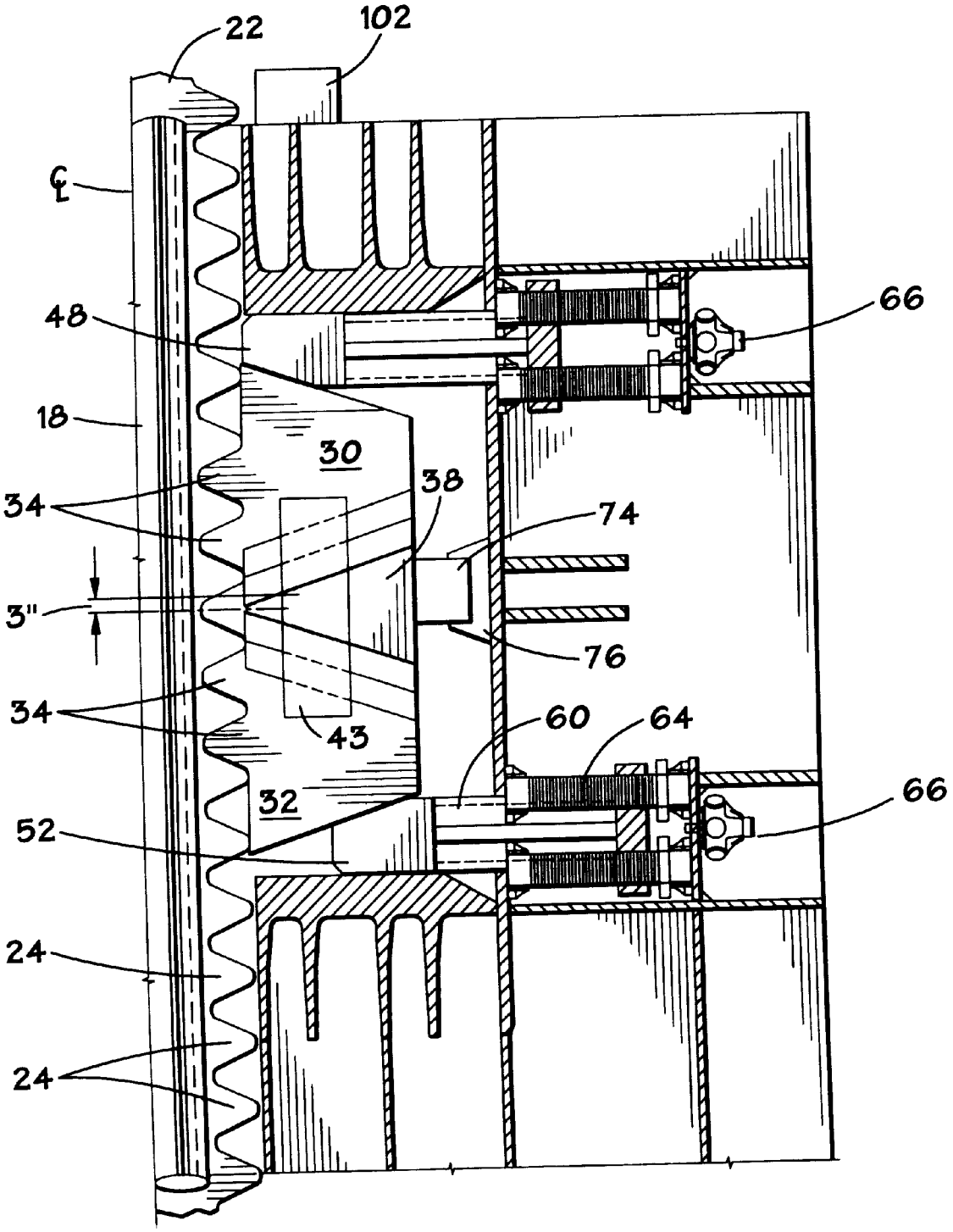
FIG. 12 is a view in elevation similar to FIG. 6, but showing elements of the system as they would appear if the teeth on the leg rack and the teeth on the chock segments initially were vertically misaligned, with the teeth of the leg rack being initially approximately 3 inches higher than the corresponding teeth of the chocks.
Figure 13:
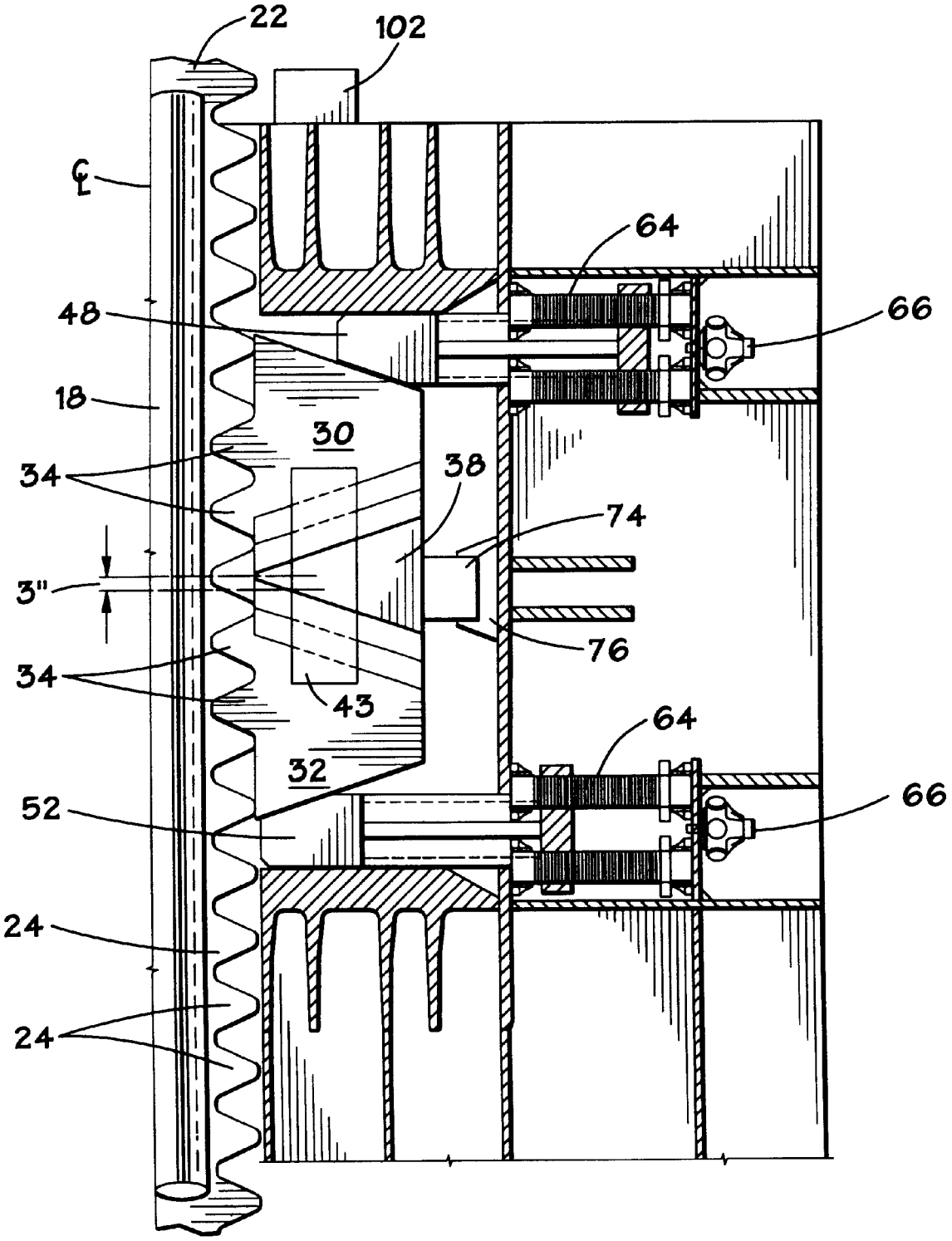
FIG. 13 is a view similar to FIG. 12, but showing the parts of the system as they would appear if the teeth of the leg rack initially were approximately 3 inches lower than the corresponding teeth of the chock segments.

Even if the chock teeth and rack teeth are substantially aligned for the first chord, under the control of the vertical alignment sensors, the chock teeth and rack teeth on the other chords for that leg may be somewhat vertically misaligned, due to manufacturing tolerances, stress deformation, etc. However, since each chock unit accommodates vertical misalignment between its chock segment teeth and the corresponding leg rack teeth, independently of the other chock units, a secure and near perfect fit between the chock teeth and rack teeth on each chock unit is assured, so long as overall misalignment of the leg chords does not exceed the vertical adjustment range designed into the units. Referring to FIGS. 12 and 13, there are illustrated the relative positions the chock segments and wedge blocks would assume when displaced upwardly (FIG. 13) and downwardly (FIG. 12) by approximately three inches in order to property align with the teeth of leg rack 22.

The foregoing disclosure and description of the preferred embodiment are illustrative and explanatory only and various changes may be made in the size, shape, materials and other details of construction and methods of operation, within the scope of the appended claims, without department from the spirit of the invention.

What is claimed is:

1. A leg locking apparatus for an offshore platform in which a hull has a leg extending therethrough and a longitudinally extending rack on said leg with a plurality of longitudinally spaced rack teeth thereon adapted to be engaged and driven by a pinion on said hull, said leg locking apparatus comprising a chock housing mounted on said hull;

a plurality of vertically aligned chock segments disposed in said housing, each said chock segment having at least one tooth adapted to matingly engage the teeth of said leg rack, each said chock segment having upper and lower inclined bearing surfaces;

a plurality of support wedge means in said chock housing and adapted to conformingly engage said upper and lower inclined bearing surfaces of said chock segments for selectively supporting said chock segments in said chock housing;

positioning means for moving said chock segments and said support wedge means horizontally relative to said housing between a stowed position in which said teeth of said chock segments do not engage said teeth of said rack and a deployed position in which said teeth of said chock segments intermesh with said teeth of said leg rack; and retaining means for selectively retaining said support wedge means in said deployed position.

2. The apparatus according to claim 1 wherein each of said chock segments has not more than three teeth adapted to matingly engage the teeth of said leg rack.

3. The apparatus according to claim 2 wherein each said chock segment has two teeth.

4. The apparatus according to claim 1 wherein said retaining means are adapted to operate independently of said positioning means.

5. The apparatus according to claim 1 wherein said positioning means comprise a plurality of double acting hydraulic cylinders, each said cylinder having one end attached to said chock housing and the other end attached either to one of said chock segments or to one of said support wedge means.

6. The apparatus according to claim 1 wherein said support wedge means comprise upper, middle and lower support wedges and wherein said retaining means comprise adjustable threaded supports with self-locking threads for selectively locking at least said upper and lower support wedges into said deployed position.

7. The apparatus according to claim 1 wherein said plurality of chock segments comprise first and second chock segments vertically aligned in said chock housing and wherein said wedge means comprise a first support wedge disposed above and adapted to engage the upper inclined bearing surface of said first chock segment, a second support wedge disposed below and adapted to engage the lower inclined bearing surface of said second chock segment and an intermediate support wedge disposed between said first and second chock segments and adapted to conformingly engage the lower inclined bearing surface of said first chock segment and the upper inclined bearing surface of said second chock segment.

8. The apparatus according to claim 7 wherein said retaining means comprise additionally a locking wedge selectively engageable with said intermediate support wedge for preventing horizontal displacement of said intermediate support wedge in a direction away from said chock teeth when said chock segments are in said deployed position.

9. The apparatus according to claim 8 comprising additionally a locking wedge block selectively engageable with each of said upper and lower chock segments for preventing horizontal displacement of said upper and lower chock segments in a direction away from said rack teeth when said chock segments are in said deployed position.

10. The apparatus according to claim 7 comprising additionally anti-rotation guide means interconnecting said first and second chock segments for preventing rotation of said chock segments relative to each other.

11. The apparatus according to claim 10 wherein said anti-rotation guide means comprise an elongated guide member having an upper inclined guide surface and a lower inclined guide surface thereon, said upper inclined surface adapted to engage a conformingly shaped inclined guide slot on said first chock segment and said lower inclined guide surface adapted to engage a conformingly shaped inclined guide slot on said second chock segment, whereby vertical movements of said chock segments relative to each other may be accommodated by horizontal movements of said guide member while said chock segments remain substantially restrained against rotation relative to each other.

12. The apparatus according claim 10 wherein said anti-rotation guide means comprise an elongated guide bar disposed between, and interconnecting, said first and second chock members, the upper end of said guide bar adapted to be received within a conformingly shaped, generally vertical, guide slot in said first chock member and the lower end of said guide bar adapted to be slidingly received within a conformingly shaped, generally vertical, guide slot formed in the body of said second chock member, whereby vertical movements of said chock members relative to each other may be accommodated by sliding movement of said guide bar in said guide slots, while said first and second chock members remain substantially restrained against rotation relative to each other.

13. The apparatus according to claim 12 comprising additionally a guide slot formed through the body of said intermediate support wedge substantially in vertical alignment with said guide slots in said first and second chock members and wherein said guide bar is slidingly received through said guide slot in said intermediate support wedge.

14. An apparatus for elevating a hull of an offshore platform comprising:

a toothed rack having a longitudinal axis and fixed longitudinally onto an upright leg extending through said hull;

a driving pinion mounted on said hull and drivingly engaging the teeth of said rack;

means to rotate said pinion relative to said rack to effect relative displacement along the longitudinal axis of said rack to thereby move said hull up and down relative to said leg;

a locking mechanism for locking said leg against longitudinal displacement relative to said hull, said locking mechanism comprising:

a housing mounted on said hull and having upper and lower bearing surfaces;

first and second vertically aligned chock segments mounted in said housing between said upper and lower bearing surfaces, said first chock segment comprising a plurality of teeth adapted to matingly engage the teeth of said rack, an upper bearing surface inclined downwardly in a direction horizontally away from said chock teeth and a lower bearing surface inclined upwardly in a direction horizontally away from said chock teeth, said second chock segment comprising a plurality of teeth adapted to matingly engage the teeth of said rack, an upper bearing surface inclined downwardly in a direction horizontally away from said chock teeth and a lower bearing surface inclined upwardly in a direction horizontally away from said chock teeth;

a first support wedge disposed between and conformingly engaging said upper bearing surface of said first chock segment and said upper bearing surface of said housing;

a second support wedge disposed between and conformingly engaging said lower power bearing surface of said second chock segment and said lower bearing surface of said chock housing;

an intermediate support wedge disposed between and conformingly engaging said lower bearing surface of said first chock segment and said upper bearing surface of said second chock segment;

positioning means for moving said first and second chock segments and said first and second support wedges horizontally in said housing between a stowed position, in which said teeth of said chock segments do not engage said teeth of said rack, and a deployed position, in which said teeth of said chock segments intermesh with said teeth of said rack; and retaining means independent of said positioning means for retaining said first and second support wedges and said intermediate support wedge in their deployed positions to thereby retain said first and second chock segments in their deployed positions.

15. The apparatus according to claim 14 wherein said positioning means comprise a plurality of double acting hydraulic cylinders, each said cylinder having one end attached to said housing and the other end attached either to one of said chock segments or to one of said first and second support wedges.

16. The apparatus according to claim 14 wherein said retaining means comprise threaded support means selectively engageable with said first and second support wedges, for preventing displacement of said deployed first and second support wedges horizontally away from said chock segments.

17. The apparatus according to claim 16 wherein said retaining means comprise additionally a locking wedge selectively engageable with said intermediate support wedge for preventing horizontal displacement of said intermediate wedge in a position away from said rack teeth when said chock segments are in said deployed position.

18. The apparatus according to claim 14, comprising additionally locking wedge blocks selectively engageable with each of said first and second chock segments for preventing horizontal displacement of said chock segments in a direction horizontally away from said rack teeth when said chock segments are in said deployed position.

19. The method for locking a leg of a jack-up platform against vertical displacement relative to a hull of said platform by chocking the teeth of a leg rack extending longitudinally of said leg, said method comprising:

providing on said hull a leg locking apparatus comprising a chock housing mounted on said hull, a plurality of vertically aligned chock segments disposed in said housing, each said chock segment having at least one tooth adapted to matingly engage the teeth of said leg rack and each said chock segment having upper and lower inclined bearing surfaces, a plurality of support wedge means in said chock housing adapted to conformingly engage said upper and lower inclined bearing surfaces of said chock segments for selectively supporting said segments in said housing, positioning means for moving said chock segments and said support wedge means horizontally relative to said housing between a stowed position in which said teeth of said chock segments do not engage the teeth of said rack and a deployed position in which said teeth of said chock segments intermesh with said teeth of said rack, and retaining means selectively retaining said support wedge means in said deployed position;

aligning said leg and said leg rack at a desired vertical position with respect to said hull;

utilizing said positioning means to move said chock segments horizontally in said housing from said stowed position to a position where the teeth of said chock segments engage corresponding teeth on said rack;

utilizing said positioning means to continue to urge said chock segments toward engagement with the teeth of said rack whereby said chock segments, responsive to urging of said positioning means, move vertically and horizontally to achieve maximum mating engagement between the teeth of said rack and the teeth of said chock segments;

utilizing said positioning means to move said support wedge means horizontally in said housing from said stowed position into a deployed position engaging said bearing surfaces of said chock segments to thereby support said chock segments against vertical and horizontal displacement relative to said leg rack;

utilizing said retaining means to retain said support wedge means against movement in a direction horizontally away from said leg rack, to thereby retain said teeth of said chock segments in locked mating engagement with said teeth of said gear rack.

* * * * *